US006826855B2

(12) United States Patent
Ruvang

(10) Patent No.: US 6,826,855 B2
(45) Date of Patent: Dec. 7, 2004

(54) EXCAVATING TOOTH POINT/ADAPTER ASSEMBLY WITH ROTATABLY LOCKABLE CONNECTOR STRUCTURE

(75) Inventor: John A. Ruvang, Lake Dallas, TX (US)

(73) Assignee: Hensley Industries, Inc., Dallas, TX (US)

( * ) Notice: Subject to any disclaimer, the term of this patent is extended or adjusted under 35 U.S.C. 154(b) by 103 days.

(21) Appl. No.: 10/287,406

(22) Filed: Nov. 4, 2002

(65) Prior Publication Data

US 2004/0083630 A1 May 6, 2004

(51) Int. Cl.[7] ..... E02F 9/28
(52) U.S. Cl. ..... 37/450; 37/455
(58) Field of Search ..... 37/455, 456, 457, 37/458, 446, 449, 450, 452, 454

(56) References Cited

U.S. PATENT DOCUMENTS

| | | | | |
|---|---|---|---|---|
| 2,618,873 A | | 11/1952 | Hostetter | 37/142 |
| 4,067,657 A | | 1/1978 | Kaarlela | 403/317 |
| 4,918,843 A | | 4/1990 | Kiesewetter et al. | 37/142 A |
| 5,272,824 A | | 12/1993 | Cornelius | 37/458 |
| 5,564,206 A | | 10/1996 | Ruvang | 37/458 |
| 5,718,070 A | | 2/1998 | Ruvang | 37/459 |
| 5,913,605 A | | 6/1999 | Jusselin et al. | 37/451 |
| 5,926,982 A | | 7/1999 | Keech et al. | 37/455 |
| 5,937,550 A | * | 8/1999 | Emrich | 37/458 |
| 5,956,874 A | | 9/1999 | Ianello et al. | 37/456 |
| 5,983,534 A | | 11/1999 | Robinson et al. | 37/459 |
| 5,992,063 A | | 11/1999 | Mack | 37/450 |
| 6,092,958 A | * | 7/2000 | Gale | 403/378 |
| 6,108,950 A | | 8/2000 | Ruvang et al. | 37/452 |
| 6,145,224 A | | 11/2000 | Stickling | 37/458 |
| 6,374,521 B1 | | 4/2002 | Pippins | 37/456 |
| 6,393,739 B1 | | 5/2002 | Shamblin et al. | 37/456 |
| 6,564,482 B2 | | 5/2003 | Ruvang | |
| 2002/0023375 A1 | | 2/2002 | Pippins | |

FOREIGN PATENT DOCUMENTS

| | | |
|---|---|---|
| AU | AU 200030147 B2 | 6/2000 |
| WO | WO 99 23316 A1 | 5/1999 |

* cited by examiner

*Primary Examiner*—Thomas B. Will
*Assistant Examiner*—Meredith Petravick
(74) *Attorney, Agent, or Firm*—Konneker & Smith, P.C.

(57) ABSTRACT

A replaceable excavating tooth point is telescoped onto an adapter nose and releasably retained thereon by an elongated, flat connector member having an untapered side periphery. The connector member longitudinally extends through aligned point and connector openings and blocks forward removal of the point from the adapter nose. A transverse point sidewall abutment surface facing one end of the installed connector member prevents it from moving outwardly through one of the point openings, and a rotatable lock member carried by the other end of the connector member and engageable with a groove in the other point opening releasably prevents the connector member from moving outwardly through the grooved point opening. A detent structure releasably holds the lock member in locking and unlocking orientations in which the lock member is prevented from moving parallel to the length of the connector member.

51 Claims, 2 Drawing Sheets

EXCAVATING TOOTH POINT/ADAPTER ASSEMBLY WITH ROTATABLY LOCKABLE CONNECTOR STRUCTURE

BACKGROUND OF THE INVENTION

The present invention generally relates to material displacement apparatus and, in a preferred embodiment thereof, more particularly relates to apparatus for releasably coupling a replaceable excavation tooth point to an associated adapter nose structure.

A variety of types of material displacement apparatus are provided with replaceable portions that are removably carried by larger base structures and come into abrasive, wearing contact with the material being displaced. For example, excavating tooth assemblies provided on digging equipment such as excavating buckets or the like typically comprise a relatively massive adapter portion which is suitably anchored to the forward bucket lip and has a reduced cross-section, forwardly projecting nose portion, and a replaceable tooth point having formed through a rear end thereof a pocket opening that releasably receives the adapter nose. To captively retain the point on the adapter nose, aligned transverse openings are formed through these interengageable elements adjacent the rear end of the point, and a suitable connector structure is driven into and forcibly retained within the aligned openings to releasably anchor the replaceable tooth point on its associated adapter nose portion.

Connector structures adapted to be driven into the aligned tooth point and adapter nose openings typically come in two primary forms—(1) wedge and spool connector sets, and (2) flex pin connectors. A wedge and spool connector set comprises a tapered spool portion which is initially placed in the aligned tooth and adapter nose openings, and a tapered wedge portion which is subsequently driven into the openings, against the spool portion, to jam the structure in place within the openings in a manner exerting high rigid retention forces on the interior opening surfaces and press the nose portion into a tight fitting engagement with the tooth pocket.

Very high drive-in and knock-out forces are required to insert and later remove the steel wedge and typically require a two man effort to pound the wedge in and out—one man holding a removal tool against an end of the wedge, and the other man pounding on the removal tool with a sledge hammer. This creates a safety hazard due to the possibility of flying metal slivers and/or the second man hitting the first man instead of the removal tool with the sledge hammer. Additionally, wear between the tooth/adapter nose surface interface during excavation use of the tooth tends to loosen the tight fit of the wedge/spool structure within the tooth and adapter nose openings, thereby permitting the wedge/spool structure to fall out of the openings and thus permitting the tooth to fall off the adapter nose.

Flex pin structures typically comprise two elongated metal members held in a spaced apart, side-by-side orientation by an elastomeric material bonded therebetween. The flex pin structure is longitudinally driven into the tooth and adapter nose openings to cause the elastomeric material to be compressed and resiliently force the metal members against the nose and tooth openings to retain the connector structure in place within the openings and resiliently press the adapter nose portion into tight fitting engagement with the interior surface of the tooth socket.

Flex pins also have their disadvantages. For example, compared to wedge/spool structures they have a substantially lower in-place retention force. Additionally, reverse loading on the tooth creates a gap in the tooth and adapter nose openings through which dirt can enter the tooth pocket and undesirably accelerate wear at the tooth/adapter nose surface interface which correspondingly loosens the connector retention force. Further, the elastomeric materials typically used in flex pin connectors are unavoidably subject to deterioration from hot, cold and acidic operating environments. Moreover, in both wedge-and-spool and flex pin connectors relatively precise manufacturing dimensional tolerances are required in the tooth point and adapter nose portions to accommodate the installation of their associated connector structures.

Proposed solutions to these various connector-based problems, limitations and disadvantages in excavation tooth point/adapter assemblies have included wedge-shaped connector members which are inserted into the aligned point and adapter nose openings having complementarily tapered configurations, with the inserted connector being resiliently biased in a longitudinal "tightening" direction relative to the point and adapter nose by a lock member carried by the connector member. The lock member is rotatably and sealingly received within an end of the connector member, bears against a portion of the tooth point, and is spring-biased longitudinally outwardly from the connector member. An example of this wedge-shaped type of connector structure is illustrated and described in U.S. Pat. No. 6,108,950 to Ruvang.

This particular wedge-shaped type of connector structure at least substantially reduces various of the problems, limitations and disadvantages discussed above in conjunction with conventional flex pins and wedge and spool connector sets. However, it has several limitations of its own. For example, due to the wedge shape of the connector member, excavating loading forces exerted on the connector member can generate a substantial axial force component on the connector member which can, in certain instances, damage the lock member and permit the connector member to be expelled from the tooth point and adapter nose openings. Moreover, because the spring-biased lock member is permitted to move into and out of the connector member, dirt may be drawn into the interior connector/lock member surface interface area and substantially degrade the seal carried by the lock member. Further, with the lock member maintained in its unlocking position for extended periods of time (for example when the overall connector structure is being stored prior to use), an elastomeric portion of the lock member detent portion is maintained in compression and can obtain an undesirable compression set.

It can be seen from the foregoing that it would be desirable to provide improved excavating tooth connector apparatus that eliminates or at least substantially reduces the above-mentioned problems, limitations and disadvantages associated with conventional excavating tooth and other material displacement equipment connector apparatus of the general type described above.

SUMMARY OF THE INVENTION

In carrying out principles of the present invention, in accordance with a representatively illustrated embodiment thereof, a specially designed connector assembly is used to releasably retain an excavating wear member, representatively a replaceable tooth point, on a support structure, representatively an adapter nose.

The connector assembly, in the representatively illustrated embodiment thereof, includes (1) an elongated flat connector member extending along a longitudinal axis and having a flat exterior side peripheral portion extending between opposite first and second ends and circumscribing the longitudinal axis in a parallel relationship therewith, and (2) a locking member rotatable received in the first connector member end and being rotatable between locking and unlocking positions in which a locking tab portion of the locking member respectively projects laterally outwardly beyond the connector member side surface periphery, and an unlocking position in which the locking tab does not project laterally outwardly beyond the connector member side surface periphery.

A detent structure within the interior of the connector member releasably retains the locking member in either selected one of its locking and unlocking positions. The locking member has no resilient force exerted thereon parallel to the length of the connector member in either of the locking and unlocking positions of the lock member, and the detent structure substantially prevents any appreciable relative movement of the lock member and the connector member parallel to the longitudinal axis of the connector member when the lock member is in either of its locking and unlocking positions. The detent structure representatively includes a rigid detent member carried by the lock member and having an associate resilient portion, and first and second circumferentially spaced detent openings disposed within the connector member interior for respectively receiving the detent member when the lock member is in its locking and unlocking positions. The resilient portion of the detent structure is in an essentially relaxed state when the lock member is in either of its locking and unlocking positions.

With the tooth point telescoped onto the adapter nose, side wall connector openings in the tooth point aligned with a connector opening transversely extending through the adapter nose, and the lock member in its unlocking position, the connector assembly is inserted into the connector openings until the opposite ends of the connector member are disposed in the opposite tooth point connector openings to thereby block forward removal of the tooth point from the adapter nose. The locking member is then rotated to its locking position. After this is done, abutment surface areas within the interior of the tooth point/adapter assembly prevent the installed connector assembly from moving outwardly through either tooth point connector opening. Representatively, these abutment surface areas include (1) a first abutment surface defined in an interior side surface recess of a first one of the two tooth point side wall connector openings into which the locking tab is moved when rotated to its locking position, the first abutment surface blocking the locking tab, and thus the entire connector assembly, from moving outwardly through the first tooth point connector opening, and (2) a second abutment surface formed on a side wall portion of the tooth point which extends into the second tooth point connector opening, reduces its cross-sectional area relative to that of the first tooth point connector opening, and blocks the installed connector assembly from moving outwardly through the second tooth point side wall connector opening.

DETAILED DESCRIPTION

Figure 1:
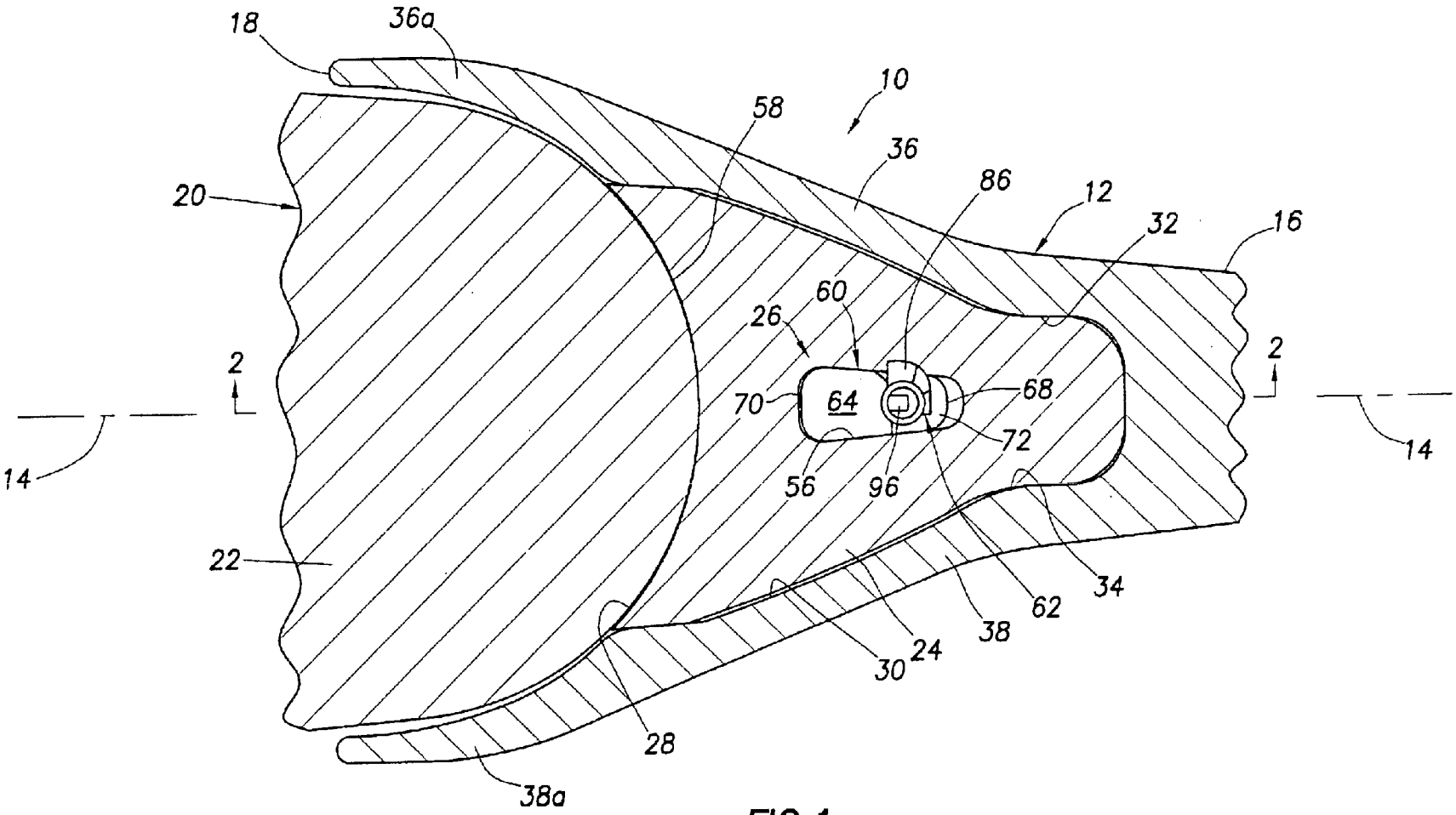
FIG. 1 is a longitudinally foreshortened, horizontally directed cross-sectional view, partly in elevation, through an excavating tooth point/adapter assembly incorporating therein a specially designed rotatably locking connector structure embodying principles of the present invention.
Figure 2:
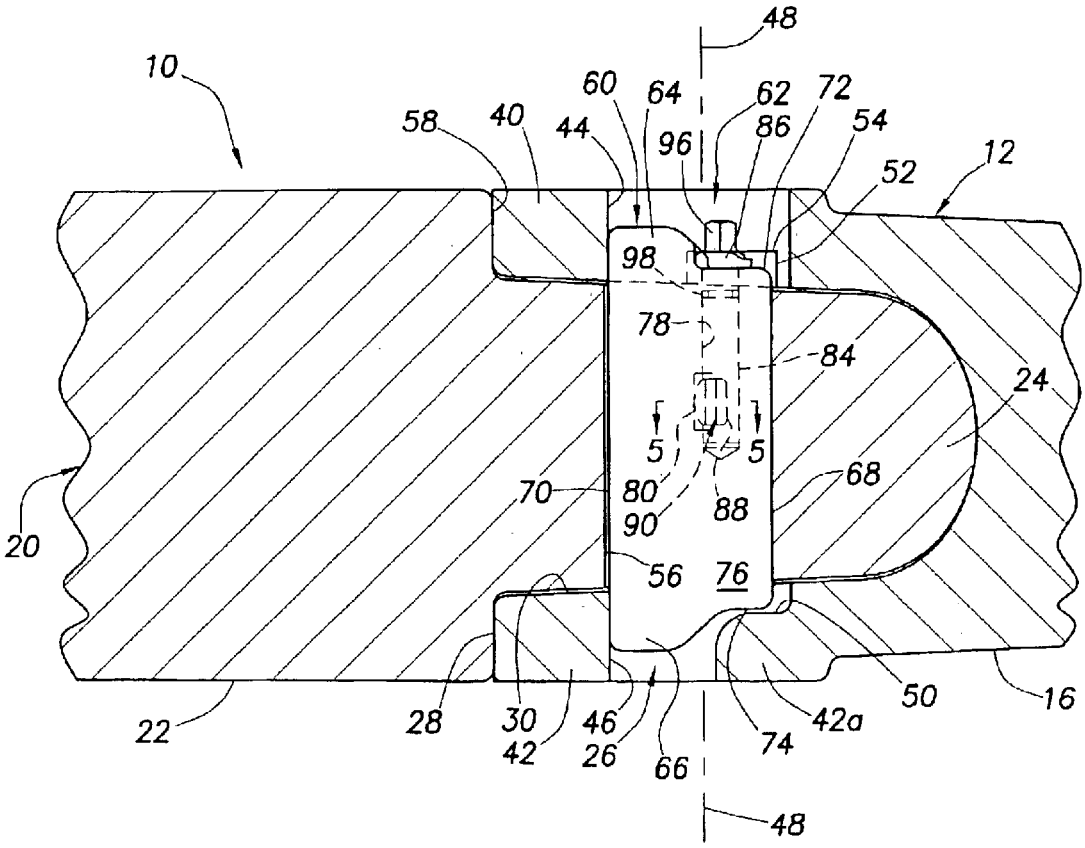
FIG. 2 is a cross-sectional view, partly in elevation, through the assembly taken along line 2—2 of FIG. 1.

As cross-sectionally illustrated in longitudinally foreshortened form in FIGS. 1 and 2, in an illustrated embodiment thereof, this invention provides an excavating tooth point/adapter assembly 10 that includes a wear member in the form of an elongated hollow replaceable tooth point 12 extending in a front-to-rear direction along a longitudinal axis 14 and having front and rear portions 16 and 18; a support structure in the form of an adapter 20 having a base portion 22 from which a smaller cross-section nose portion 24 forwardly projects; and a specially designed rotatably lockable connector assembly 26 used to releasably retain the tooth point 12 on the adapter nose 24 as subsequently described herein.

Representatively, the tooth point 12 and adapter 20 have configurations similar to the tooth point and associated adapter illustrated and described in copending U.S. application Ser. No. 09/843,681 (now U.S. Pat. No. 6,564,482) filed on Apr. 27, 2001 and assigned to the same assignee as the assignee of the present invention. However, the tooth point 12 and the adapter 20 could have a wide variety of alternate shapes without departing from principles of the present invention. Additionally, while the present invention is illustrated and described herein as being used in conjunction with an adapter as a representative support structure and a tooth point as a representative wear member carried by the support structure, it will be readily appreciated by those of ordinary skill in this particular art that different types of support structures and associated wear members could be utilized without departing from principles of the present invention. As an example, but not by way of limitation, the adapter 20 could an intermediate adapter connected at its rear end to a base adapter, and the tooth point 12 could be an intermediate adapter having a front end portion on which a replaceable tooth point was installed.

Referring now to FIGS. 1 and 2, the tooth point 12 has a concavely curved rear end surface portion 28 through which a pocket 30 forwardly extends into the interior of the tooth point 12. As can best be seen in FIG. 1, from its forward entrance into the tooth point 12 through the curved rear end surface portion 28, the pocket 30 tapers forwardly and vertically inwardly and has a reduced cross-section stabilizing front end portion with generally horizontal opposite top and bottom side surface portions 32 and 34.

Pocket 30 defines on the tooth point 12 a pair of opposite top and bottom side walls 36 and 38, and a pair of opposite vertical side walls 40 and 42 which rearwardly terminate at the curved rear end surface 28 of the tooth point 12. Rearwardly and vertically divergent rear end portions 36*a* and 38*a* of the top and bottom tooth point walls 36,38 extend rearwardly past the curved rear tooth point end surface 28. Aligned connector openings 44,46 respectively extend inwardly through the vertical tooth point side walls 40 and 42 into the pocket 30 and are spaced apart along an axis 48 transverse to the axis 14. As best illustrated in FIG. 2, a portion 42*a* of the side wall 42 extends rearwardly across the connector opening 46 in a manner reducing its cross-sectional area compared to that of the other connector opening 44.

For purposes later described herein, side wall portion 42*a* (see FIG. 2) has an inner side recess which defines on the side wall portion 42*a* an inner side abutment surface 50 transverse to the axis 48 and facing the pocket area 30. Additionally, as also shown in FIG. 2, the inner side surface of the side wall opening 44 has a circumferentially extending recess 52 formed therein inwardly of the outer side surface of the side wall 40. Recess 52 opens inwardly into the pocket 30 and has (at its top side as viewed in FIG. 2) an abutment surface 54 transverse to the axis 48.

The adapter nose 24 is complementarily and removably received in the tooth point pocket 30 and has a connector opening 56 extending therethrough parallel to the axis 48 and aligned with the tooth point connector openings 44,46. Adapter base 22 has a convexly curved front surface 58 which circumscribes the rear end of the adapter nose 24 and is complementarily and slidably engageable by the concave rear end surface portion 28 of the tooth point 12. With the adapter nose 24 removably received in the tooth point pocket 30 as illustrated in FIGS. 1 and 2, the rear end portions 36*a*,38*a* of the tooth point 12 protectively overlie top and bottom side surface portions of the adapter base 22.

With reference now to FIGS. 1–4, the connector assembly 26 includes an elongated flat connector member 60 and a locking member 62. Connector member 60 has opposite ends 64 and 66, a tapered cross-section along its length which is elongated in a direction parallel to the axis 14, opposite front and rear longitudinal side edges 68 and 70, and corner recess areas extending laterally inwardly from the side edges 68 and 70 and defining in opposite end corner portions of the connector member 60 longitudinally inset end surfaces 72 and 74. The outer longitudinally extending peripheral side surface 76 of the flat connector member 60 circumscribes the longitudinal axis of the connector member and is parallel thereto as opposed to being tapered with respect thereto.

Figure 5:
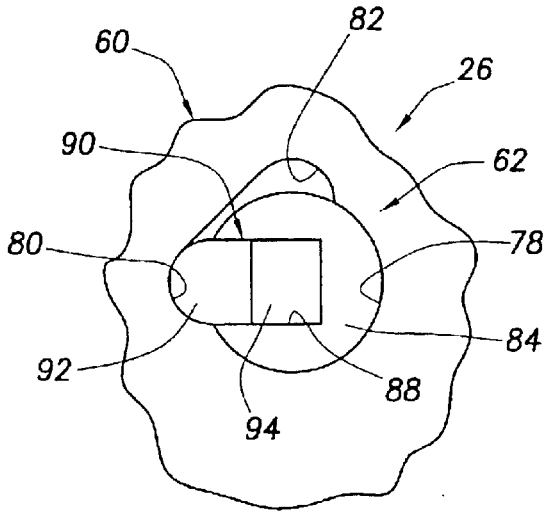
FIG. 5 is an enlarged scale schematic partial cross-sectional view through the connector structure taken along line 5—5 of FIG. 2.

A circular bore or opening 78 extends longitudinally inwardly through the inset end surface 72 of the connector member 60 and has a detent recess area formed in its interior side surface. Preferably, as best illustrated in FIG. 5, this detent recess area comprises two detent recesses 80,82 circumferentially separated by ninety degrees and longitudinally aligned within the opening 78.

The lock member 62 has an elongated cylindrical body 84 a lower longitudinal portion of which (as viewed in FIG. 2) is coaxially and rotatably received within the connector member opening 78, with an upper end portion of the body 84 projecting outwardly from the inset connector member end surface portion 72. A transverse locking tab 86 is anchored to the exposed upper end of the lock member body 84, and a lower end portion of the body 84 within the opening 78 has a lateral detent recess 88 extending radially inwardly through its outer side surface. As schematically depicted in cross-sectional form in FIG. 5, a detent structure 90 is received in the detent recess 88 and representatively comprises a radially outer metal detent member 92 secured to an elastomeric, radially inner detent portion 94. The detent member 92 is resiliently biased to project outwardly from the recess 88, but may be radially forced into recess 88 against the resilient resistance of the elastomeric portion 94.

Figure 3:
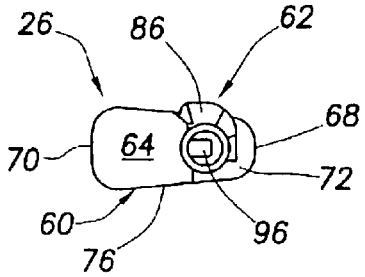
FIG. 3 is a top end elevational view of the connector structure with a rotatable locking portion thereof being in its locking position shown in FIG. 2.
Figure 4:
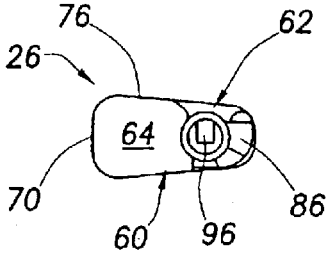
FIG. 4 is a top end elevational view of the connector structure with its rotatable locking portion in its unlocking position.

A noncircular driving structure 96 (for example, a hex or square head portion) projects upwardly from the locking tab 86 and may be engaged by a suitable driving tool (not shown) used to forcibly rotate the locking member 62 between (1) a locking position in which the locking tab 86 projects laterally outwardly beyond the outer peripheral side surface 76 of the connector member 60 as shown in FIGS. 1–3, and (2) an unlocking position in which the locking tab 86 does not project laterally outwardly beyond the outer peripheral side surface 76 of the connector member 60 as illustrated in FIG. 4. The driving structure 96 could, of course, have a variety of alternate configurations, such as a noncircular recessed portion, a slotted area, or the like, if desired.

With the lock member 62 rotated to its locking position the detent member 92 snaps into the internal connector member detent recess 80 to thereby bring the elastomeric detent portion 94 to an essentially relaxed orientation and releasably retain the lock member 62 in its locking position. As the lock member 62 is subsequently being rotated from its locking position to its unlocking position, the detent member 92 is depressed into the lock member detent recess 88 and then snaps outwardly into the internal connector member detent recess 82 to thereby bring the elastomeric detent portion 94 back to an essentially relaxed state and releasably retain the lock member 62 in its unlocking position.

The same movement of the detent member 92, of course, when the lock member 62 is subsequently rotated back to its locking position from its unlocking position. An annular resilient seal member 98 (see FIG. 2) is supported on and coaxially circumscribes the lock member body 84, between the locking tab 86 and the lock member detent recess 88, and slidingly engages the interior side surface of the connector member opening 78 to inhibit the entry of dirt and other abrasive material into the interior of the connector member 60 during use of the tooth adapter assembly 10.

As can best be seen in FIG. 2, the vertical heights of the interior connector member detent recesses 80,82 (as viewed in FIG. 2) are substantially identical to the height of the detent member 92. Accordingly, the interaction between the detent member 92 and these detent recesses 80,82 substantially prevents relative longitudinal movement between the connector member 60 and the lock member 62 when the locking member 62 is in either of its locking and unlocking positions.

With the tooth point 12 rearwardly telescoped onto the adapter nose 24 as illustrated in FIG. 2, the connector assembly 26 is operatively Installed by first rotating its lock member 62 to its unlocking position and then inserting the connector assembly 26, connector end 66 first, downwardly (as viewed in FIG. 2) through the aligned connector openings 44,56,46, with the front edge 68 of the connector member 60 facing forwardly, so that the connector member 60 is complementarily received in the nose connector opening 56, and the connector member end abutment surface 74 contacts the tooth point abutment surface 50. In this inserted orientation of the connector assembly 26, the opposite ends 64,66 of the connector member 60 respectively extend into the tooth point connector openings 44,46 to thereby block forward removal of the installed tooth point 12 from the adapter nose 24.

The inserted connector assembly 26 is then releasably locked in this blocking orientation by simply rotating the lock member 62 from its unlocking position to its locking position to cause the locking tab 86 to enter the tooth point recess 62 and face outwardly face its associated abutment surface 54 as may be best seen in FIG. 2. Thus, the cooperating abutment surfaces 50,74 adjacent the connector member end 66 preclude the connector assembly 26 from passing outwardly through the tooth point connector opening 46, and the cooperating abutment surfaces 54,72 prevent the connector assembly from passing outwardly through the tooth point connector opening 44.

The representatively illustrated abutment surface configuration within the interior of the tooth poinvadapter assembly 10, namely the abutment surface sets 50,74 and 54,72, may be altered in a variety of manners without departing from the principles of the present invention. For example, but not by way of limitation, the tooth point abutment surface 50 could be relocated to within the adapter nose 24 (and the corresponding connector member abutment surface accordingly relocated to face this adapter nose abutment surface). As another example, but also not by way of limitation, the lower abutment surface set 50,74 (as viewed in FIG. 2) could be eliminated, and the tooth point recess 52 modified to have two facing abutment surfaces which face the opposite sides of the locking tab 86 in its locking position and serve to prevent the connector assembly 26 from longitudinally moving outwardly through either of the tooth point connector openings 44,46.

Because the outer peripheral side surface 76 of the connector member 60 is parallel to the axis 48, operating loads on the tooth point/adapter assembly 10 do not impose appreciable longitudinally directed loads on the connector member 60 which might tend to expel it from the connector openings 44,46,56 and exert substantial forces on the lock member 62. Moreover, the connector assembly 26 may be installed without the need to pound it into the connector openings. Because of this, two or more of the assemblies 10 may be placed closer together due to the lack of required pounding room. Also, because the detent structure in the connector assembly 26 substantially prevents relative longitudinal movement between the connector member 60 and the lock member 62 during use of the tooth/adapter assembly 10, entry of dirt and other abrasive material into the interior of the connector member 60, and associated degradation of the interior resilient seal member 98, is substantially reduced. Additionally, because the resilient portion of the lock member detent structure is in an essentially relaxed state in the lock member's unlocking position, undesirable "compression set" in this resilient detent portion resulting from lengthy storage periods of the connector assembly with the lock member in its unlocking position is substantially eliminated The foregoing detailed description is to be clearly understood as being given by way of illustration and example only, the spirit and scope of the present invention being limited solely by the appended claims.

What is claimed is:

1. Apparatus for use in removably coupling a replaceable material displacement wear member to a support structure portion received in an interior pocket area of said wear member, said wear member and said support structure portion having generally alignable connection openings therein, said apparatus comprising an elongated, generally flat connector member insertable into the aligned connection openings and having:

first and second ends spaced apart along a first axis;

an exterior peripheral surface portion longitudinally extending between said first and second ends, said exterior peripheral surface portion being parallel to and circumscribing said first axis;

an opening longitudinally extending inwardly through said first end along a second axis parallel to said first axis;

a detent recess area extending radially outwardly from the interior side surface of said opening; and a lock structure operable to releasably retain said connector member in the connection openings.

2. The apparatus of claim 1 wherein:

said connector member has, along at least a major portion of its length, a cross-section which is elongated in a direction transverse to said first axis.

3. The apparatus of claim 2 wherein:

said elongated cross-section has a tapered, generally wedge-shaped configuration.

4. The apparatus of claim 1 wherein:

said first end has an axially inset area with a surface portion extending transversely to said first axis, and said opening longitudinally extends inwardly through said surface portion of said axially inset area.

5. The apparatus of claim 4 wherein:

said axially inset area is a notched corner area of said first end.

6. The apparatus of claim 4 wherein:

said connector member has a longitudinally extending exterior side edge, and said axially inset area laterally extends inwardly from said exterior side edge.

7. The apparatus of claim 1 wherein:

said detent recess area includes circumferentially spaced first and second detent recesses extending radially outwardly from the interior side surface of said opening.

8. The apparatus of claim 7 wherein:

said first and second detent recesses are aligned with one another in a direction parallel to said first axis.

9. The apparatus of claim 1 wherein said lock structure comprises a lock member having:

a cylindrical body coaxially received in said opening for rotation relative to said connecter member between locking and unlocking positions, said body having an outer end portion disposed externally of said opening and having a transverse locking tab portion projecting outwardly therefrom.

10. The apparatus of claim 9 wherein:

said body has no net axial force thereon in either of said locking and unlocking positions.

11. The apparatus of claim 9 wherein:

said outer end portion of said body has a drive structure thereon which facilitates the driven rotation of said body relative to said connector member between said locking and unlocking positions.

12. The apparatus of claim 9 wherein:

said locking tab portion, in said locking position thereof, projects outwardly past exterior peripheral surface portion of said connector member in a direction transverse to said first axis, and said locking tab portion, in said unlocking position thereof, does not project appreciably outwardly past said exterior peripheral surface portion of said connector member in said direction transverse to said first axis.

13. The apparatus of claim 12 wherein:

said apparatus further comprises a recess extending laterally into an exterior side surface portion of said lock member body, and a detent member supported on said body and being resiliently biased to project outwardly through said recess, and said detent recess area of said connector member includes a detent recess into which said detent member resiliently snaps, when said lock member is rotated to said locking position, to releasably restrain said lock member in said locking position.

14. The apparatus of claim 13 wherein:

when said lock member is in said locking position, said detent member and said detent recess cooperate to preclude appreciable movement of said lock member relative to said connector member parallel to said first axis.

15. The apparatus of claim 12 wherein:

said apparatus further comprises a recess extending laterally into an exterior side surface portion of said lock member body, and a detent member supported on said body and being resiliently biased to project outwardly through said recess therein and being resiliently depressible into said recess, said detent recess area in said connector member includes circumferentially spaced first and second detent recesses extending radially outwardly from the interior side surface of said opening in said connector opening, said detent member being resiliently forced into said first and second detent recesses, to releasably restrain said lock member against rotation relative to said connector member, when said lock member is respectively rotated to said locking and unlocking positions thereof.

16. The apparatus of claim 15 wherein:

said first and second detent recesses respectively cooperate with said detent member to preclude appreciable movement of said lock member relative to said connector member parallel to said first axis when said lock member is in said locking and unlocking positions.

17. The apparatus of claim 9 further comprising:

an annular resilient seal member coaxially carried by said lock member body between said detent recess area and said first end of said connector member and sealingly engaging the interior side surface of said opening.

18. A replaceable material displacement wear member comprising:

a front end;

a rear end spaced apart from said front end along a first axis;

a pocket area extending forwardly through said rear end;

first and second opposite side wall portions partially bounding said pocket; and aligned first and second connector openings spaced apart along a second axis transverse to said first axis and respectively extending inwardly through said first and second side wall portions into said pocket area, said second side wall portion extending into said second connector opening in a manner reducing its cross-sectional area relative to the cross-sectional area of said first connector opening and laterally offsetting an axially outer portion of said second connector opening relative to said second axis, said second side wall portion further having an inwardly facing abutment surface transverse to said second axis.

19. The replaceable material displacement wear member of claim 18 wherein:

said abutment surface is formed by an inner side surface recess in said second side wall portion.

20. The replaceable material displacement wear member of claim 18 further comprising:

a recess formed in the inner side surface of said first connector opening.

21. The replaceable material displacement wear member of claim 20 wherein:

said recess has an open side facing said pocket area.

22. The replaceable material displacement wear member of claim 18 wherein:

said replaceable material displacement wear member is a tooth point.

23. A replaceable material displacement tooth point comprising:

a front end;

a rear end spaced apart from said front end along a first axis;

a pocket area extending forwardly through said rear end;

first and second opposite side wall portions partially bounding said pocket; and aligned first and second connector openings spaced apart along a second axis transverse to said first axis and respectively extending inwardly through said first and second side wall portions into said pocket area, said second side wall portion extending into said second connector opening in a manner reducing its cross-sectional area relative to the cross-sectional area of said first connector opening, said second side wall portion further having an inwardly facing abutment surface transverse to said second axis, and said tooth point having a curved rear end surface portion through which said pocket area forwardly extends, said first and second opposite side wall portions rearwardly terminate at said curved rear end surface, and said tooth point further has third and fourth opposite side wall portions which are transverse to said first and second opposite side wall portions and extend rearwardly past said curved rear end surface portion.

24. Material displacement apparatus comprising:

a support structure having a front portion extending forwardly along a first axis and having a connector opening extending therethrough along a second axis transverse to said first axis;

a replaceable wear member rearwardly telescoped onto said front portion and having a pair of opposite first and second side wall connector openings aligned with said front portion connector opening; and a connector assembly releasably retaining said wear member on said front portion, said connector assembly including:

an elongated connector member longitudinally extending through and removably received in said front portion connector opening and said first and second wear member connector openings along said second axis and having first and second end portions respectively received in said first and second wear member connector openings and blocking removal of said wear member from said front support structure portion, said connector member having an exterior peripheral surface portion longitudinally extending between said first and second end portions, said exterior peripheral surface portion being parallel to and circumscribing said second axis;

a lock member rotatably carried by said connector member first end portion;

a first abutment surface disposed within the interior of said material displacement apparatus, extending transversely to said second axis, and blocking passage of said lock member, and thus said connector member, outwardly through said first wear member connector opening; and a second abutment surface disposed within the interior of said material displacement apparatus, extending transversely to said second axis, and blocking passage of said connector member outwardly through said second wear member connector opening.

25. The material displacement apparatus of claim 24 wherein:

said support structure is an adapter, and said front portion of said support structure is an adapter nose, and said wear member is a replaceable tooth point.

26. The material displacement apparatus of claim 24 wherein:

said connector member has, along at least a major portion of its length, a cross-section which is elongated in a direction transverse to said second axis and parallel to said second axis.

27. The material displacement apparatus of claim 26 wherein:

said elongated cross-section has a tapered, generally wedge-shaped configuration.

28. The material displacement apparatus of claim 24 wherein:

said lock member has a cylindrical body rotatably received in an opening extending axially inwardly through said first end portion of said connector member, and a transverse locking portion secured to an outer end portion of said body external to said connector member, said lock member being in a locking position wherein said locking portion thereof projects outwardly beyond said exterior peripheral surface portion of said connector member in a direction transverse to said second axis and opposes said first abutment surface to preclude passage of said connector member outwardly through said first wear member connector opening, said lock member being rotatable from said locking position to an unlocking position in which said lock portion does not project appreciably outwardly past said exterior peripheral surface portion of said connector member in said direction and thereby permits removal of said connector member outwardly through said first wear member connector opening.

29. The material displacement apparatus of claim 28 wherein:

said lock member body has no resilient axial force thereon in either of said locking and unlocking positions.

30. The material displacement apparatus of claim 28 wherein:

said first end portion of said connector member has a longitudinally inset area with a surface portion transverse to said second axis, and said opening extends inwardly through said inset surface and parallel to said second axis.

31. The material displacement apparatus of claim 30 wherein:

said inset surface portion is a notched corner area of said first end portion of said connector member.

32. The material displacement apparatus of claim 30 wherein:

said connector member has a longitudinally extending exterior side edge, and said longitudinally inset area extends inwardly from said exterior side edge.

33. The material displacement apparatus of claim 28 further comprising:

cooperating detent structures, disposed on said connector member and said lock member body, releasably retaining said lock member in either selected one of said locking and unlocking positions thereof.

34. The material displacement apparatus of claim 33 wherein:

said cooperating detent structures include a detent recess area extending radially outwardly from the interior side surface of said opening, and a resiliently supported detent member carried by said lock member body and being operatively associated with said detent recess area.

35. The material displacement apparatus of claim 34 wherein:

said detent recess area includes circumferentially spaced first and second detent recesses extending radially outwardly from the interior side surface of said opening, and said detent member is receivable in said first detent recess when said lock member is in said locking position, and receivable in said second detent recess is in said unlocking position.

36. The material displacement apparatus of claim 34 wherein:

said cooperating detent structures operate to preclude appreciably movement of said lock member relative to said connector member parallel to said second axis when said lock member is in said locking and unlocking positions.

37. The material displacement apparatus of claim 35 wherein:

said first and second detent recesses respectively cooperate with said detent member to preclude appreciable movement of said lock member relative to said connector member parallel to said second axis when said lock member is in said locking and unlocking positions.

38. The material displacement apparatus of claim 34 further comprising:

an annular resilient seal member coaxially carried by said lock member body between said detent recess area and said first end portion of said connector member and sealingly engaging the interior side surface of said opening.

39. The material displacement apparatus of claim 24 wherein:

said support structure has a base portion having a curved front surface from which said front portion forwardly projects, and said wear member has a curved rear end surface portion complementarily engageable with said curved front surface of said base portion and through which a pocket area forwardly extends, said pocket area complementarily receiving said front portion, said wear member having first and second opposite side wall portions through which said first and second wear member connector openings respectively extend, and third and fourth opposite side wall portions transverse to said first and second opposite side wall portions, said third and fourth opposite side wall portions extending rearwardly past said curved rear end surface portion of said wear member.

40. The material displacement apparatus of claim 39 wherein:

said front surface of said base portion is convexly curved, and said rear end surface portion of said wear member is concavely curved.

41. The material displacement apparatus of claim 39 wherein:

said support structure is an excavating adapter, and said front portion of said support structure is an adapter nose, and said wear member is a replaceable excavating tooth point.

42. The material displacement apparatus of claim 28 wherein:

said first wear member connector opening has a circumferentially extending groove disposed therein, receiving said locking portion and defining said first abutment surface.

43. The material displacement apparatus of claim 24 wherein:

said second abutment surface is an interior side wall surface of said wear member which faces a surface on said second connector member end portion transverse to said second axis.

44. The material displacement apparatus of claim 24 wherein:

the cross-sectional area of said second wear member connector opening is reduced relative to the cross-sectional area of said first wear member connector opening by a side wall portion of said wear member on which said second abutment surface is disposed.

45. The material displacement apparatus of claim 44 wherein:

said side wall portion of said wear member has an inner side recess area on which said second abutment surface is disposed.

46. A replaceable material displacement wear member comprising:

a front end;

a rear end spaced apart from said front end along a first axis;

a pocket area extending forwardly through said rear end;

first and second opposite side wall portions partially bounding said pocket area; and aligned first and second connector openings spaced apart along a second axis transverse to said first axis and respectively extending inwardly through said first and second side wall portions into said pocket area, said first connector opening having an abutment recess formed in its inner side surface, said wear member having a curved rear end surface portion through which said pocket area forwardly extends, said first and second opposite side wall portions rearwardly terminate at said curved rear end surface, and said tooth point further has third and fourth opposite side wall portions which are transverse to said first and second opposite side wall portions and extend rearwardly past said curved rear end surface portion.

47. The replaceable material displacement wear member of claim 46 wherein:

said abutment recess has an open side facing said pocket area.

48. The replaceable material displacement wear member of claim 46 wherein:

said replaceable material displacement wear member is a tooth point.

49. A replaceable material displacement wear member comprising:

a front end;

a rear end spaced apart from said front end along a first axis;

a pocket area extending forwardly through said rear end;

first and second opposite side wall portions partially bounding said pocket; and aligned first and second connector openings spaced apart along a second axis transverse to said first axis and respectively extending inwardly through said first and second side wall portions into said pocket area, said second side wall portion extending into said second connector opening in a manner reducing its cross-sectional area relative to the-cross-sectional area of said first connector opening, said second side wall portion further having an inwardly facing abutment surface transverse to said second axis, said wear member having a rear end surface portion curved about an axis parallel to said second axis and through which said pocket area forwardly extends, said first and second opposite side wall portions rearwardly terminating at said curved rear end surface.

50. A replaceable material displacement wear member comprising:

a front end;

a rear end spaced apart from said front end along a first axis;

a pocket area extending forwardly through said rear end;

first and second opposite side wall portions partially bounding said pocket area; and aligned first and second connector openings spaced apart along a second axis transverse to said first axis and respectively extending inwardly through said first and second side wall portions into said pocket area, said first connector opening having an abutment recess formed in its inner side surface, said wear member having a rear end surface portion curved about an axis parallel to said second axis and through which said pocket area forwardly extends, said first and second opposite side wall portions rearwardly terminating at said curved rear end surface.

51. Material displacement apparatus comprising:

a support structure having a front portion extending forwardly along a first axis and having a connector opening extending therethrough along a second axis transverse to said first axis;

a replaceable wear member rearwardly telescoped onto said front portion and having a pair of opposite first and second side wall connector openings aligned with said front portion connector opening; and an elongated, generally flat connector member removably received in the aligned connector openings and captively retaining said wear member on said support structure, said connector member having:

first and second ends spaced apart along a first axis;

an exterior peripheral surface portion longitudinally extending between said first and second ends, said exterior peripheral surface portion being parallel to and circumscribing said first axis;

an opening longitudinally extending inwardly through said first end along a second axis parallel to said first axis;

a detent recess area extending radially outwardly from the interior side surface of said opening; and a lock structure releasably retaining said connector member in said aligned connector openings.

* * * * *